United States Patent [19]

De Maria et al.

[11] 4,296,175

[45] Oct. 20, 1981

[54] HOLLOW ACRYLONITRILE POLYMER FIBER

[75] Inventors: Francesco De Maria, Gulf Breeze; Ronald E. Pfeiffer, Pensacola, both of Fla.

[73] Assignee: American Cyanamid Company, Stamford, Conn.

[21] Appl. No.: 133,059

[22] Filed: Mar. 24, 1980

Related U.S. Application Data

[63] Continuation-in-part of Ser. No. 13,773, Feb. 21, 1979, abandoned.

[51] Int. Cl.[3] ..... D02G 3/00

[52] U.S. Cl. ..... 428/398; 428/376; 428/397; 428/36

[58] Field of Search ..... 428/398, 376, 397; 264/182; 525/59

[56] References Cited

U.S. PATENT DOCUMENTS

| | | | |
|---|---|---|---|
| 2,965,925 | 12/1960 | Dietzsch, Sr. | 428/398 |
| 3,131,428 | 5/1964 | Mika | 264/177 X |
| 3,340,571 | 9/1967 | Bishop et al. | 264/177 F |
| 3,600,491 | 8/1971 | Shimoda et al. | 264/182 X |
| 3,755,234 | 8/1973 | Chujo et al. | 260/29.6 WA |
| 3,839,081 | 10/1974 | Tanahashi et al. | 428/394 |
| 3,851,036 | 11/1974 | Tzentis | 264/182 |
| 3,923,755 | 12/1975 | Piloni | 526/287 |
| 3,957,936 | 5/1976 | Lauchenauer | 428/376 X |
| 3,984,601 | 10/1976 | Blickenstaff | 428/376 X |
| 4,085,174 | 4/1978 | Ishikawa et al. | 428/398 X |
| 4,163,770 | 8/1979 | Porosoff | 264/210.3 |

FOREIGN PATENT DOCUMENTS

| | | | |
|---|---|---|---|
| 604964 | 9/1960 | Canada | 525/59 |
| 633346 | 12/1961 | Canada | 525/59 |
| 722544 | 11/1965 | Canada | 264/177 F |
| 718137 | 11/1954 | United Kingdom | 525/59 |
| 838141 | 6/1960 | United Kingdom | 428/398 |

*Primary Examiner*—Lorraine T. Kendell

*Attorney, Agent, or Firm*—Frank M. Van Riet

[57] ABSTRACT

A monolobal acrylonitrile polymer fiber is disclosed in which a continuous hollow extends throughout the fiber length, which hollow is surrounded completely by a solid polymer composition substantially devoid of sheathcore structure, density gradient, and void structure, said fiber being less than about 50 deniers per filament and having desirable textile properties.

5 Claims, No Drawings

HOLLOW ACRYLONITRILE POLYMER FIBER

CROSS-REFERENCE TO RELATED APPLICATION

This application is a continuation-in-part of Application Ser. No. 013,773, filed Feb. 21, 1979, now abandoned.

This invention relates to a monolobal hollow acrylonitrile polymer fiber having suitable denier and physical properties for use in textile applications. More particularly, this invention relates to such a fiber hving a monolobal cross-section comprising an inner hollow area which extends uniformly throughout the entire fiber length and, completely surrounding said hollow area, an outer said polymer area having a uniform structure, said inner hollow area being substantially extended to its fullest open dimensions.

Hollow fibers are desirable for a number of reasons. Such fibers possess high bulk compared to solid fibers of the same nominal diameter and are highly desirable in the fabrication of wearing apparel wherein they provide improved comfort. They also provide increased moisture adsorption, wicking, improved esthetic qualities such as touch of hand, and sparkle or internal reflectance.

Up to the present time, acrylonitrile polymer fiber has been commercially produced by either wet or dry spinning procedures. In these procedures, a polymer solvent is necessary to provide a spinning composition which is coagulated to form a solid fiber. In wet spinning, coagulation is effected by a liquid medium which washes out or dilutes the polymer solvent. In dry spinning, coagulation is effected by a heated medium which evaporates the polymer solvent.

In preparing hollow fibers by dry spinning procedures, the spinning composition is extruded through an annular orifice to form a hollow fiber and fluid under pressure is introduced through the annulus to prevent the hollow from collapsing during processing. When the fiber is processed to remove polymer solvent and is stretched for orientation, the cross-sectional shape of the fiber becomes dogbone like in appearance and thus is bilobal in configuration with a constricted hollow.

In preparing hollow fiber by wet spinning procedures, the polymer swells upon entering the liquid coagulant and any continuous hollow formed by gas pressure in a fiber thereof is reduced to discontinuous bubbles. When the fiber is subsequently dried to collapse the swollen polymer structure, the resulting fiber contains a very limited, discontinuous hollow area and has poor utility as a hollow fiber.

Percent developments in the field of acrylontrile polymer fiber have led to a melt-spinning process involving fusion melts. A fusion melt arises when a composition of acrylonitrile polymer and water in proper proportions are heated under suitable pressure. Since the melt forms at a temperature above the boiling point of water at atmospheric pressure, it is necessary to employ at least antogeneous pressure to maintain water in liquid state. The resulting melt forms at a temperature which is below the degradation or deterioration temperature of the polymer which normally does not melt without degradation or deterioration. The fusion melt is homogeneous and of single phase and can be extruded under conditions which provide fiber. Typical procedures for preparing fiber from fusion melts are described in U.S. Pat. Nos. 3,984,601, issued Oct. 5, 1976 to R. H. Blickenstaff and 4,163,770, issued Aug. 7, 1979 to H. Porosoff, however, no rovisions are taught or suggested therein for preparing hollow textile fibers by spinning said fusion melts.

There continues to exist, therefore, the need for hollow, monolobal acrylonitrile polymer fiber that has a substantially fully opened or extended hollow area occurring continuously throughout the fiber length and is of suitable denier and physical properties for textile uses. The provision for such a fiber would fulfill a long-felt need and constitute a significant advance in the art.

In accordance with the present invention, there is provided an acrylonitrile polymer fiber having a monolobal cross-sectional shape comprising (1) an inner hollow area extending uniformly throughout the entire fiber length and having a substantially fully opened cross-section and completely surrounding said inner hollow area, (2) an outer solid polymer area having a uniform structure, said fiber being less than about 50 denier per filament and having suitable physical properties for textile uses.

As indicated, the hollow acrylonitrile polymer fiber of the present invention is monolobal and has a substantially fully opened hollow area extending throughout its length. The fiber also has the proer denier and physical properties for use in textile applications. Such an acrylonitrile polymer fiber is unexpected in view of the art which produces hollow acrylonitrile polymer fibers which contain constricted hollows or are polylobal with constricted hollows.

By "monolobal", as that term is used herein, and in the appended claims, is meant that the rounded fiber form has a single projection associated therewith.

By a "substantially fully opened cross-section", as that term is used herein, and in the appended claims, is meant that the cross-section provides the widest opening between its confines that is possible.

In preferred embodiments of the present invention, the fiber has a denier of less than about 20 per filament and has physical properties comparable to solid acrylonitrile polymeer fiber used in textile applications. In addition, the preferred hollow fiber of the present invention will have a sufficiently large hollow extending continuously therethrough to provide maximum benefits associated with hollow structure, preferably the follow area constituting a least about one third of the fiber cross-sectional area.

The hollow fiber of the present invention demonstrates highly improved wicking properties. This property coupled with the fast-drying properties associated with acrylonitrile polymer fiber leads to unexpected utility in such applications as towelling and the like.

The hollow fiber of the present invention is provided by a melt-spinning procedure using a homogeneous, single-phase fusion melt of acrylonitrile polymer and water following certain required processing steps. Unless these required processing steps are followed, fiber properties are impaired and the fiber is unsuitable for textile and many other uses.

In carrying out processing to provide the hollow acrylonitrile polymer fiber of the present invention, a homogeneous single phase fusion melt of a hydrophilic fiber-forming acrylonitrile polymer and water is prepared in accordance with conventional procedure. This fusion melt is then extruded through a spinneret assembly which provides a hollow structure such as a spinneret plate having annular orifices or a conventional plate modified with pins or suitable inserts to provide a fiber of hollow structure. Such extrusion is conducted in such a manner that the extrudate which is in the form of hollow filaments issues directly into a steam-pressurized solidification zone maintained under conditions of saturation, temperature and pressure such that the filaments solidify, remain in stretchable state, and retain sufficient water to remain in plastic state. These conditions also prevent formation of a sheath-core fiber structure within the solid polymer area and minimize formation of a density gradient and voids therein. While the nascent filaments remain within the steam-pressurized solidification zone, they are subjected to orientation stretching at stretch ratios adequate to provide desirable textile properties in the fiber which results following processing. Such stretching can be accomplished within the steam-pressurized solidification zone because under the conditions maintained, sufficient water remains within the filaments to maintain the filaments in plastic state. Stretching may be accomplished in one or more stages while the filaments are within the solidification zone and can lead to fine denier filaments as well as highly desirable physical properties for textile purposes.

The acrylonitrile polymer-water fusion melt when spun through a spinneret directly into a steam-pressurized solidification zone solidifies rapidly without formation of sticky surfaces on the filaments produced and the filaments retain the shape of the spinneret orifices with high conformity thereto. As a result, it is not necessary to employ any special handling to maintain the imparted orifice configuration such as injection of a secondary fluid to prevent the hollow from collapsing. As a result, such process enables a variety of fiber shapes and hollow configurations to be employed to produce fiber having excellent conformity to the shape-forming orifices employed including those providing hollow structures. This has not prevently been possible with acrylonitrile polymer fibers because of the requirement for polymer solvent in the commercial wet and dry spinning procedures.

After the fiber has been solidified and stretched in the steam-pressurized solidification zone as described, the filaments are dried under suitable conditions of temperature and humidity to minimize or prevent void formation within the solid polymer area of the filaments. After suitable drying as indicated, it is desirable to relax the stretched and dried filaments in steam to obtain a desirable balance of physical properties.

To prepare the melt-spun, hollow acrylonitrile polymer fiber of the present invention, a suitable acrylonitrile polymer composition is selected to form the polymer area of the fiber structure. Any acrylonitrile polymer composition having at least about 50 weight percent of acrylonitrile units is suitable provided the polymer composition also has associated therewith hydrophilic moieties to provide the transparent nature of the polymer area. There are a number of techniques by which the hydrophilic moieties can be introduced into the acrylonitrile polymer composition effectively.

One method of introducing hydrophilic units into an acrylonitrile polymer composition is to copolymerize acrylonitrile with a hydrophilic comonomer. Another method is to polymerize the acrylonitrile polymer composition in the presence of a redox initiator system that introduces acid groups at the polymer chain ends. Yet another method is to polymerize the acrylonitrile polymer composition in the presence of a pre-formed hydrophilic polymer such as polyvinyl alcohol. Still another method is to hydrolyze a small portion of the acrylonitrile units of a pre-formed acrylonitrile polymer to provide hydrophilic acrylic acid and/or acrylamide units. Further, one can modify a portion of the acrylonitrile units of a pre-formed acrylonitrile polymer by suitable reaction to provide hydrophilic groups, such as by reaction with ethylenediamine to provide imidazoline units. These and other methods known to those skilled in the art can be used alone or in combination to provide hydrophilic units associated with tthe acrylonitrile polymer composition used to prepare the fiber of the present invention.

As acrylonitrile polymer composition useful to provide the fiber of the present invention may be a single polymer or a blend of compatible polymers so long as the composition provides a minimum of at least about 50 weight percent of acrylonitrile units and hydrophilic moieties associated therewith to achieve the desired transparency. Individual compatible polymers in blends need not contain the specified amounts of acrylonitrile units or hydrophilic moieties so long as the total blend composition provides the required amounts of such materials. By "hydrophilic moieties" as that term is used herein are meant those portions of the acrylonitrile polymer composition that are hydrophilic and include such moieties as sulfonic acid groups, polyvinyl alcohol segments, repeating comonomer units, and the like. By "associated therewith" as that term is used herein is meant that such hydrophilic units are present in the acrylonitrile polymer composition in a manner appropriate for the particular hydrophilic moieties involved. Thus, sulfonic acid groups may arise as end groups on polymer chains or as a functional group on a comonomer; polyvinyl alcohol moieties may be present as part of a grafted polymer other hydrophilic moieties may arise as repeating units in a copolymer prepared from two or more monomers or as a result of hydrolyzing a suitable polymer; they may also arise as a result of suitable reaction of a pre-formed polymer; they may arise as a compatible polymer blend; and such other methods as are known to those skilled in the art. Thus, the term "associated therewith" is intended to include the various manners in which hydrophilic moieties are present in the acrylonitrile polymer composition since no other terminology is appropriate to cover all of the manners described.

The amount of hydrophilic moieties in a given acrylonitrile polymer composition that achieves the desired transparency will vary widely depending upon many factors. The content of hydrophilic moieties will be influenced by the nature of the hydrophilic groups, the molecular weight of the polymer, the content of acrylonitrile in the polymer, the nature of the polymer composition, i.e., copolymer, graft, blend, etc., the presence or absence of more than one type of hydrophilic moieties, processing conditions and other variables. However, useful contents of hydrophilic moieties can readily be found by trial following the teachings given herein as a guide.

The content of hydrophilic moieties may conveniently be expressed as about 1 to about 10 weight percent based on the total weight of the polymer composition of a hydrophilic monomer or of that type of repeating units with which the hydrophilic units are associated, i.e., vinyl alcohol units.

Individual acrylonitrile polymers useful in preparing the acrylonitrile polymer composition for melt-spinning the fiber of the present invention do not have to contain the hydrophilic moieties or acrylonitrile units, as indicated above, so long as the acrylonitrile polymer composition is suitably constituted to provide these components. With such contents implicit, suitable acrylonitrile polymers include homopolymers of acrylonitrile and copolymers of acrylonitrile and one or more of the following monomers:

HYDROPHOBIC MONOMERS

Methyl acrylate, ethyl acrylate, butyl acrylate, methoxymethyl acrylate, beta-chloroethyl acrylate, and the corresponding esters of methacrylic acid and chloro-acrylic acid; vinyl chloride, vinyl fluoride, vinyl bromide, vinylidene chloride, vinylidene bromide, allyl chloride, 1-chloro-1-bromoethylene; methacrylonitrile; methyl vinyl ketone; vinyl formate, vinyl acetate, vinyl propionate, vinyl stearate, vinyl benzoate, N-vinyl phthalimide, N-vinyl succinimide; methylene malonic esters; itaconic esters; N-vinyl carbazole; vinyl furane; alkyl vinyl ethers; diethyl citraconate, diethylmesaconate styrene, dibromostyrene; vinyl naphthalene; 2-methyl-1-vinylimidazole, 4-methyl-1-vinylimidazole, 5-methyl-1-vinylimidazole; and the like.

HYDROPHILIC MONOMERS

Acrylic acid, methacrylic acid, alphachloroacrylic acid, itaconic acid, vinyl sulfonic acid, styrenesulfonic acid, methallyl sulfonic acid, p-methoxyallyl benzene sulfonic acid, acrylamidomethylpropane sulfonic acid, ethylene-$\alpha,\beta$-dicarboxylic acids and their salts; acrylamide, methacrylamide, dimethylacrylamide, isopropylacrylamide; allyl alcohol; 2-vinylpyridine, 4-vinylpyridine, 2-methyl-5-vinylpyridine; vinylpyrrolidone vinylpiperidone; 1,2-dihydroxypropylmethacrylate, hydroxyethyl methacrylate; 1-trimethylammonium-2-hydroxypropyl methacrylate methosulfate; and the like.

In preparing acrylonitrile polymers and copolymers it is desirable to employ redox systems such as sodium persulfate-sodium bisulfite to initiate and control the polymerization. Such use results in sulfonic acid end groups on the polymer formed. The proportion of sulfonic acid end groups in the polymer will vary with molecular weight of the polymer, higher proportions being present in polymers of low molecular weight. These sulfonic acid end groups should be taken into account when determining the content of hydrophilic moieties in the acrylonitrile polymer composition used to provide the fiber of the present invention. Acrylonitrile polymer compositions containing sulfonic acid groups arising solely from the use of an appropriate redox system can be effectively employed to provide the fiber of the present invention. When hydrophilic pre-formed polymers such as polyvinyl alcohol, polyvinyl pyrrolidone, polyethylene oxide, polyacrylamide, polyacrylic acid, and the like are to be used to provide the acrylonitrile polymer composition, it is desirable that such pre-formed polymers be added to the monomer composition to be polymerized to provide the acrylonitrile units. Individual polymers of the composition may range in molecular weight from about 10,000 to 200,000 or more so long as the composition provides fiber of desirable properties.

Once a desired acrylonitrile polymer composition for forming fiber has been selected, it is next necessary to prepare a single phase homogeneous fusion melt of the composition and water. A single phase fusion melt of acrylonitrile polymer composition and water results when suitable quantities of polymer composition and water are heated at elevated temperature and pressure sufficient to maintain water in liquid state. The amount of water necessary will vary depending upon the polymer composition employed. For a given polymer composition, there will be a range of water contents that will provide the single phase fusion melt at the operating temperature and pressure. This can readily be determined from a phase diagram. Use of too low a water content or temperature will result in a separate phase of unmelted polymer. Use of too high a water content will result in a separate phase of polymer-water melt and an added phase of free water. The fusion melt should be obtained at a temperature safely below the deterioration or decomposition temperature of the polymer composition. Sufficient temperature and mixing should be employed to ensure that a homogeneous fusion melt is obtained.

The fusion melt is conveniently obtained in conjunction with spinning using a screw extruder coupled with a pump and spinneret. A suitable procedure for melt extrusion is described in U.S. Pat. No. 3,991,153 issued Nov. 9, 1976 to G. K. Klausner et al. Other types of melt-spinning devices may be used such as a piston extruder in conjunction with a spinneret, for example.

In carrying out a preferred method for preparing the fiber of the present invention, the homogeneous single phase fusion melt of acrylonitrile polymer composition and water is extruded through a spinneret directly into a steam pressurized solidification zone maintained under conditions such that the nascent extrudate is solidified but is maintained in a plastic state so that the nascent extrudate may be subjected to orientation stretching while within the solidification zone. As the stretched extrudate emerges from the solidification zone, it enters atmospheric conditions.

After the extrudate has emerged from the solidification zone, the extrudate is next subjected to conditioning in an oven maintained at certain conditions of temperature and humidity as reflected by dry and wet bulb temperatures. Generally, the dry bulk will be in the range of about 110°-180° C. and the wet bulb temperature will be in the range of about 60°-100° C. The time of treatment may vary widely depending upon the wet and dry bulb temperatures used and generally will vary from about 10 to 15 minutes. This conditioning step is conducted before any uncontrolled or tensionless shrinkage of the extrudate has occurred. This conditioning step may be conducted on the extrudate in a free-to-shrink condition or under tension.

After conducting the conditioning step as described one may conduct additional optional processing steps if desired. Subsequent to the conditioning step described immediately above, certain optional processing steps may be carried out to augment the dyeing characteristics. One provision is to subject the conditioned extrudate to dry heat at a temperature in the range of about 130°-220° C. for 1 to 30 minutes, the time decreasing with increasing temperature. A second provision is to subject the conditioned extrudate to steaming such as in an autoclave.

The invention is more fully illustrated by the example which follows wherein all parts and percentages are by weight unless otherwise specified.

EXAMPLE

A conventional spinneret plate having a plurality of orifices of 300 microns diameter was centrally fitted with insert pins to form an annular orifice. Each pin was 175 micron in diameter.

A grated acrylonitrile polymer of the following composition way employed:

| | |
|---|---|
| Acrylonitrile | 85% |
| Methyl methacrylate | 11.9% |
| Poly(vinyl alcohol) | 3% |
| Acrylamidomethylpropanesulfonic acid | 0.1% |

The polymer had a kinematic molecular weight of 40,000. Kinematic molecular weight ($M_k$) is determined from the viscosity measurement of a 1% solution of the polymer in 50% sodium thiocyanate at 40° C. using the formula: $M_k = V \times 10{,}500$, where V is the absolute viscosity in centipoise (after correction for viscometer constant).

A mixture of 84.6 parts polymer, 15.4 parts water, and 0.25 parts of a glycol stearate type lubricant was fed to an extruder, melted and extruded through the hollow fiber spinneret described above directly into a steam pressurized solidification zone maintained at 13 pounds per square inch gauge pressure with saturated steam. The filaments were stretched at a stretch ratio of 9.2 in the first stage and 6.4 in a second stage. The resultiing 6.5 d/f fiber was dried at 139° C. dry bulb/74° C. wet bulb and steam relaxed at 116° C. The final fiber obtained was hollow and monolobal in cross-section and had the following properties.

| | | |
|---|---|---|
| Denier per filament | 9.7 | |
| Straight Tenacity | 2.7 | gms/denier |
| Straight Elongation | 21% | |
| Loop Tenacity | 2.0 | gms/denier |

-continued

| | |
|---|---|
| Loop Elongation | 18% |

When the ends of the resultant hollow fiber are submerged in water dyed for tracing, water wicks up the hollow fiber about 4 inches, while no wicking is observed in a solid fiber used as a control. The color of the dyed water can be seen in the fiber, constituting evidence of its transparency.

We claim:

1. An acrylonitrile polymer fiber having a monolobal cross-sectional shape comprising (1) an inner hollow area extending uniformly throughout the entire fiber length and having a substantially fully opened cross-section and completely surrounding said inner hollow area, (2) an outer solid polymer area having a uniform structure, said fiber being less than about 50 denier per filament and having suitable physical properties for textile uses and said acrylonitrile polymer being a hydrophilic polymer provided by adding a pre-formed polymer selected from the group consisting of polyvinyl alcohol, polyvinyl pyrrolidone, polyethylene oxide, polyacrylamide and polyacrylic acid to acrylonitrile and one or more monomers copolymerizable therewith in proportions which provide at least about 50 weight percent acrylonitrile and about 1 to about 10 weight percent of hydrophilic moieties in the resulting polymer.

2. The fiber of claim 1 wherein said hollow area constitutes about one-third or more of the total fiber cross-section.

3. The fiber of claim 1 wherein said denier is less than about 20 per filament.

4. The fiber of claim 1 wherein said denier is less than about 10 per filament.

5. The fiber of claim 1 wherein said acrylonitrile polymer is a polyvinyl alcohol grafted with acrylonitrile, methyl methacrylate and acrylamidomethylpropane sulfonic acid.

* * * * *